US006981655B1

(12) United States Patent
Mattes

(10) Patent No.: US 6,981,655 B1
(45) Date of Patent: Jan. 3, 2006

(54) INJECTOR FOR A FUEL INJECTION SYSTEM FOR INTERNAL COMBUSTION ENGINES WITH AN INTEGRATED SYSTEM PRESSURE SUPPLY

(75) Inventor: Patrick Mattes, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 376 days.

(21) Appl. No.: 10/088,897

(22) PCT Filed: Sep. 28, 2000

(86) PCT No.: PCT/DE00/03393

§ 371 (c)(1),
(2), (4) Date: Aug. 1, 2002

(87) PCT Pub. No.: WO01/23751

PCT Pub. Date: Apr. 5, 2001

(30) Foreign Application Priority Data

Sep. 29, 1999 (DE) ..... 199 46 612

(51) Int. Cl.
*B05B 1/08* (2006.01)
*B05B 1/30* (2006.01)
*F02M 39/00* (2006.01)

(52) U.S. Cl. ..... 239/102.2; 239/102.1; 239/585.1; 239/585.5; 239/533.3; 239/88

(58) Field of Classification Search ..... 239/102.1, 239/102.2, 585.1–585.5, 533.2, 533.3, 533.8, 239/533.9, 88–93; 251/129.15, 129.21
See application file for complete search history.

(56) References Cited

U.S. PATENT DOCUMENTS 4,129,253 A * 12/1978 Bader et al. ..... 239/88
4,728,074 A * 3/1988 Igashira et al. ..... 251/57
4,826,081 A * 5/1989 Zwick ..... 239/91
4,852,803 A * 8/1989 Gaskell ..... 239/86
6,029,902 A * 2/2000 Hickey et al. ..... 239/88

FOREIGN PATENT DOCUMENTS

GB 1320057 6/1973

* cited by examiner

*Primary Examiner*—Davis Hwu
(74) *Attorney, Agent, or Firm*—Ronald E. Greigg

(57) ABSTRACT

An injector for a fuel injection system for internal combustion engines is proposed, whose system pressure supply is integrated with the injector. This results in a simple design with at the same time a low requirement for driving capacity on the part of the high-pressure pump for supplying system pressure.

14 Claims, 3 Drawing Sheets

$P_{cr}$
7
3
5
9
11
17
X
18
1
15
13
$P_{syst}$
$P_{cr}$

INJECTOR FOR A FUEL INJECTION SYSTEM FOR INTERNAL COMBUSTION ENGINES WITH AN INTEGRATED SYSTEM PRESSURE SUPPLY

CROSS-REFERENCE TO RELATED APPLICATIONS

This application is a 35 U.S.C. application of PCT/DE 00/03393, filed on Sep. 28, 2000.

BACKGROUND OF THE INVENTION

1. Field of the Invention

The invention is based on an injector for a fuel injection system for internal combustion engines, having a high-pressure connection, the high-pressure connection communicating with an inflow conduit via a bore.

2. Description of the Prior Art

Some injectors, because of their design, require a system pressure that is markedly less than the pressure $P_{cr}$ in the common rail, that is, the injection pressure. For instance, in injectors with a piezoelectric actuator, to lengthen the stroke of the piezoelectric actuator and compensate for the temperature-dictated length, a hydraulic booster is used. To fill this hydraulic booster, a system pressure of up to 20 bar must be present in the injector upon starting and during operation. Furnishing the requisite quantity of leak fuel is accomplished either by internal leaks in the injector or from outside.

Since in some embodiments of injectors no internal leaks occur, until now in these embodiments the pressure has had to be furnished from outside via high-pressure lines. Such an embodiment, because of the high pressure level and the high operating temperatures is expensive to produce and is vulnerable to malfunction.

Another disadvantage of the system pressure supply according to the prior art is that the system pressure is adjusted by means of throttles with a constant flow rate. This kind of throttling requires a high driving capacity on the part of the high-pressure pump and reduces the efficiency of the engine accordingly.

From FIG. 13 of German Patent Disclosure DE 39 36 619, an injection nozzle is known that has a high-pressure connection; the high-pressure connection communicates hydraulically with an inflow conduit via a bore, and a conduit to the system pressure supply branches off from the bore, and a bush with a longitudinal bore is disposed in the bore. In this injection nozzle, the longitudinal bore is embodied as an inflow conduit for a control chamber. The inflow conduit is supplied directly via the bore with fuel from the high-pressure connection. With this arrangement, it is not possible to furnish a simple, operational reliable system pressure supply for an injector.

Nor is this possible with the prior art, German Published, Nonexamined Patent Application DE-OS 28 54 921 that is cited in DE 39 36 619.

OBJECTS AND SUMMARY OF THE INVENTION

It is the object of the invention to furnish an injector with a piezoelectric actuator whose system pressure supply is simple, economical and operationally reliable. Moreover, the capacity requirement of the high-pressure pump for the system pressure supply should be low.

According to the invention, in an injector for a fuel injection system for internal combustion engines, having a high-pressure connection, wherein the high-pressure connection communicates hydraulically with an inflow conduit via a bore, wherein a conduit to the system pressure supply branches off from the bore, and wherein a bush with a longitudinal bore is disposed in the bore, this object is attained in that the inflow conduit is supplied with fuel from the high-pressure connection through the longitudinal bore of the bush, and that the fuel inflow to the conduit is effected outside the bush.

This object is attained according to the invention by an injector for a fuel injection system for internal combustion engines, having a high-pressure connection, the high-pressure connection communicating hydraulically with an inflow conduit via a bore, and a conduit to the system pressure supply branches off from the bore, and a bush with a longitudinal bore is disposed in the bore.

This injector has the advantage that in the annular gap between the bush and the bore, the high pressure from the high-pressure connection is reduced so far that at the point where the conduit to the system pressure supply branches off from the bore, essentially only the requisite system pressure now prevails. Thus the system pressure supply is integrated with the injector, so that expensive external system pressure supply lines that are vulnerable to malfunction can be dispensed with. Moreover, the fuel flow into the conduit to the system pressure supply decreases as the pressure in the high-pressure connection increases, so that the requirement for driving capacity on the part of the high-pressure pump for the system pressure supply is low. Moreover, simple hoses can be used to remove the leak fuel, since the leak fuel is removed without pressure.

In one embodiment of the invention, there is a play, in particular of 6 to 8 $\mu$m, between the bore and the bush, so that an annular gap of defined thickness (3 to 4 $\mu$m) is formed between the bore and the bush, in which gap the fuel flowing from the high-pressure connection to the conduit to the system pressure supply reduces its pressure so far that the required pressure, for instance of 20 bar, is present in the conduit to the system pressure supply.

In one embodiment of the invention, it is provided that on one end of the bush, the longitudinal bore, bush and bore are sealed off from one another, and that in the region of this end, the conduit to the system pressure supply branches off from the bore, so that the fuel that is under high pressure from the high-pressure connection cannot flow into the conduit to the system pressure supply in a short circuit, bypassing the annular gap between the bore and the bush.

A further variant provides that both ends of the bush are approximately equally far away from the branching point of the conduit, so that in every case, the fuel under high pressure from the high-pressure connection must flow through an annular gap before it reaches the conduit to the system pressure supply. Thus it is also possible to dispense with a seal on one end of the bush between the bush and the bore. This makes this embodiment especially operationally reliable.

Further supplements to the invention provide that the injector has a leak fuel return line and that the leak fuel return line communicates with the conduit to the system pressure supply, so that excess fuel, which has for instance flowed from the high-pressure connection into the conduit to the system pressure supply, can be removed from the injector, and the pressure in the conduit to the system pressure supply and in the hydraulic booster does not increase excessively.

In other features of the invention, a pressure holding valve is disposed in the leak fuel return line, which maintains a minimum pressure, in particular of 15 to 20 bar, so that the requisite system pressure is always present.

A variant of the invention provides that the injector has a piezoelectric actuator, so that in injectors of this design as well, the advantages of the system pressure supply according to the invention can be utilized.

In a supplement to the invention, between the piezoelectric actuator and a control valve there is a hydraulic booster, which is filled via the conduit to the system pressure supply, so that the filling is accomplished simply and reliably.

BRIEF DESCRIPTION OF THE DRAWINGS

Further advantages and advantageous features of the invention can be learned from the following detailed description, taken with the drawings, in which.

DESCRIPTION OF THE PREFERRED EMBODIMENTS

Figure 1:
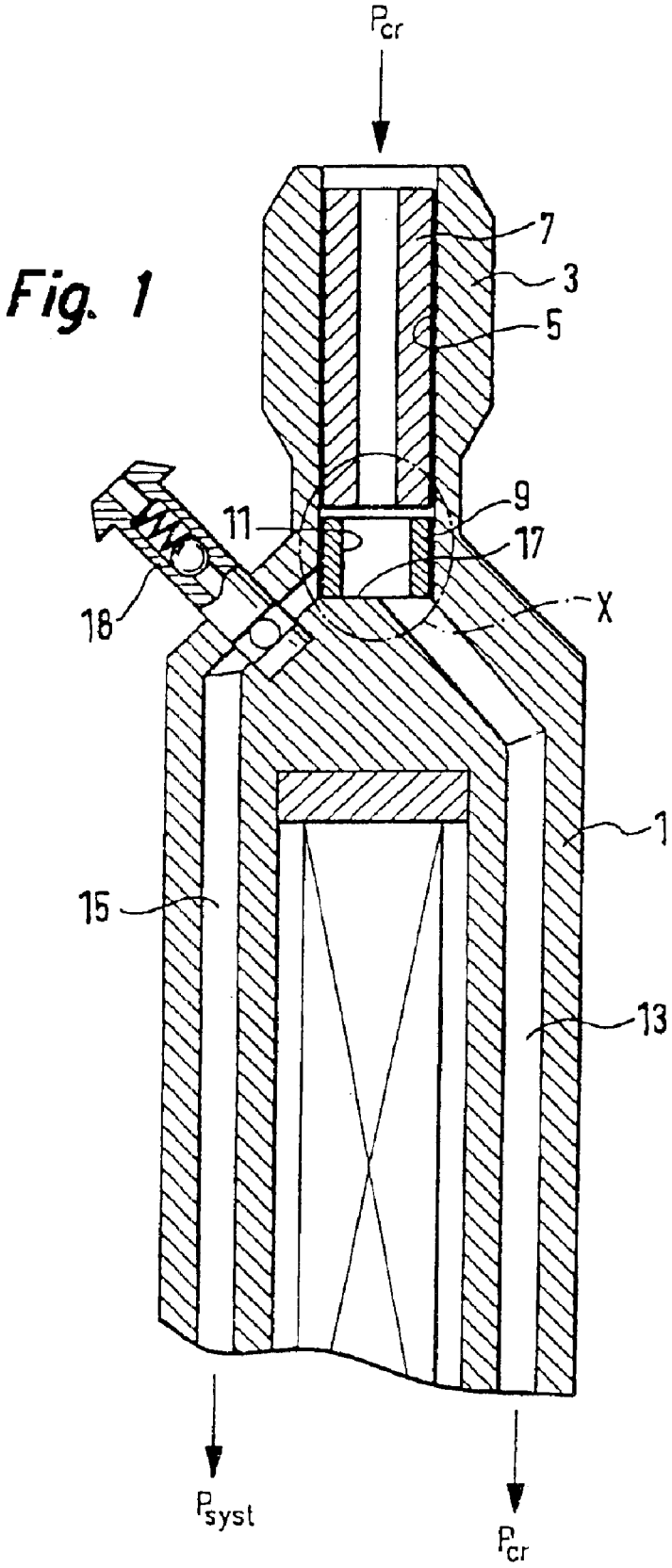
FIG. 1, a first embodiment of an injector of the invention in longitudinal section.

FIG. 1 shows an injector of the invention, with a housing 1 on whose upper end is a high-pressure connection 3. In the installed state of the injector, a high-pressure line, not shown, opens into this high-pressure connection 3 and supplies the injector with fuel, which is at high pressure $P_{cr}$, from the common rail, also not shown, or the injection pump, likewise not shown. The high-pressure connection 3 has a bore 5. A rod filter 7 is disposed in the upper part of the bore and prevents contaminants from reaching the injector. Below the rod filter 7, a bush 9 is disposed in the bore 5. The bush 9 has a longitudinal bore 11. Through the longitudinal bore 11, a hydraulic communication is established between the high-pressure line, not shown, and an inflow conduit 13, which supplies the control valve, not shown, and the injection nozzle with fuel that is at high pressure. A conduit 15 to the system pressure supply branches off in the lower region of the bore 5.

The bush 9 is joined sealingly at its lower face end to the bottom 17 of the bore 5. This means that the fuel that is under high pressure in the high-pressure connection 3 can reach the conduit 15 to the system pressure supply only through the annular gap between the bush 9 and the bore 5. In the process, a pressure reduction takes place, so that by the time the fuel reaches the conduit 15 to the system pressure supply, it has only the requisite system pressure $P_{syst}$ of about 15 to 20 bar.

To prevent the flow rate in the conduit 15 to the system pressure supply from rising as well with increasing pressure $P_{cr}$ in the high-pressure connection 3, the bush 9 is designed such that it is pressed in the direction of the bore 5 as a result of the pressure difference between the longitudinal bore 11 and the annular gap between the bush 9 and the bore 5. As a result, the annular gap between the bush 9 and the bore 5 is reduced in size, and the consequence is an increased reduction of pressure in the annular gap.

Above a pressure that is dependent on the design of the bush 9 and housing 1 as well as on the pressure in the high-pressure connection 3, the bush 9 is pressed against the bore 5, so that no further fuel from the high-pressure connection 3 can enter the conduit 15 to the system pressure supply. This prevents impermissibly high pressures from prevailing in the conduit 15 to the system pressure supply and in the hydraulic booster connected to it. The fuel flowing into the conduit 15 to the system pressure supply is diverted into the leak fuel return line, not shown, via a pressure holding valve 18. The pressure holding valve 18 can for instance be a spring-loaded ball valve, which is adjusted such that if the system pressure $P_{syst}$ of about 15 to 20 bar in the conduit 15 to the system pressure supply is exceeded, it opens and thus brings about a reduction in the prevailing pressure level in the conduit 15.

Figure 2:
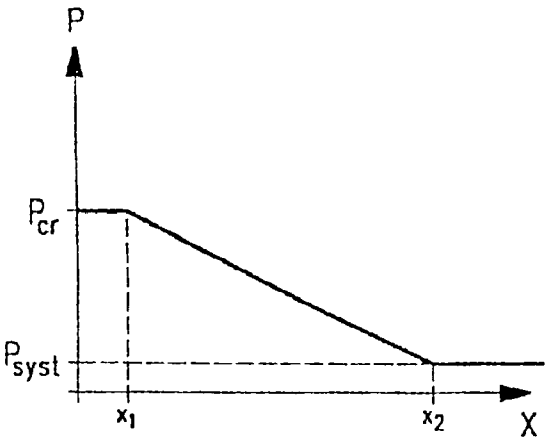
FIG. 2, a detail marked X of the injector of FIG. 1.

In FIG. 2, the detail marked X in FIG. 1 is shown. The bore 5, rod filter 7, inflow conduit 13, conduit 15 to the system pressure supply and the bush 9 can be seen. In FIG. 2, the bush 9 is not deformed by the pressure difference between the longitudinal bore 11 and an annular gap 19.

As soon as fuel flows through the annular gap 19, its pressure decreases continuously, in accordance with the P/X graph shown next to the bush 9, so that an increasing pressure difference ensues between the fuel located in the longitudinal bore 11 and that located in the annular gap 19. The consequence of this pressure difference is a deformation, not shown in FIG. 2, of the bush 9. As soon as the pressure difference between the fuel in the longitudinal bore 11 and in the annular gap 19 exceeds a certain amount, the bush 9 is pressed against the bore 5. This breaks the hydraulic communication between the high-pressure connection 3 and the conduit 15.

Figure 3:
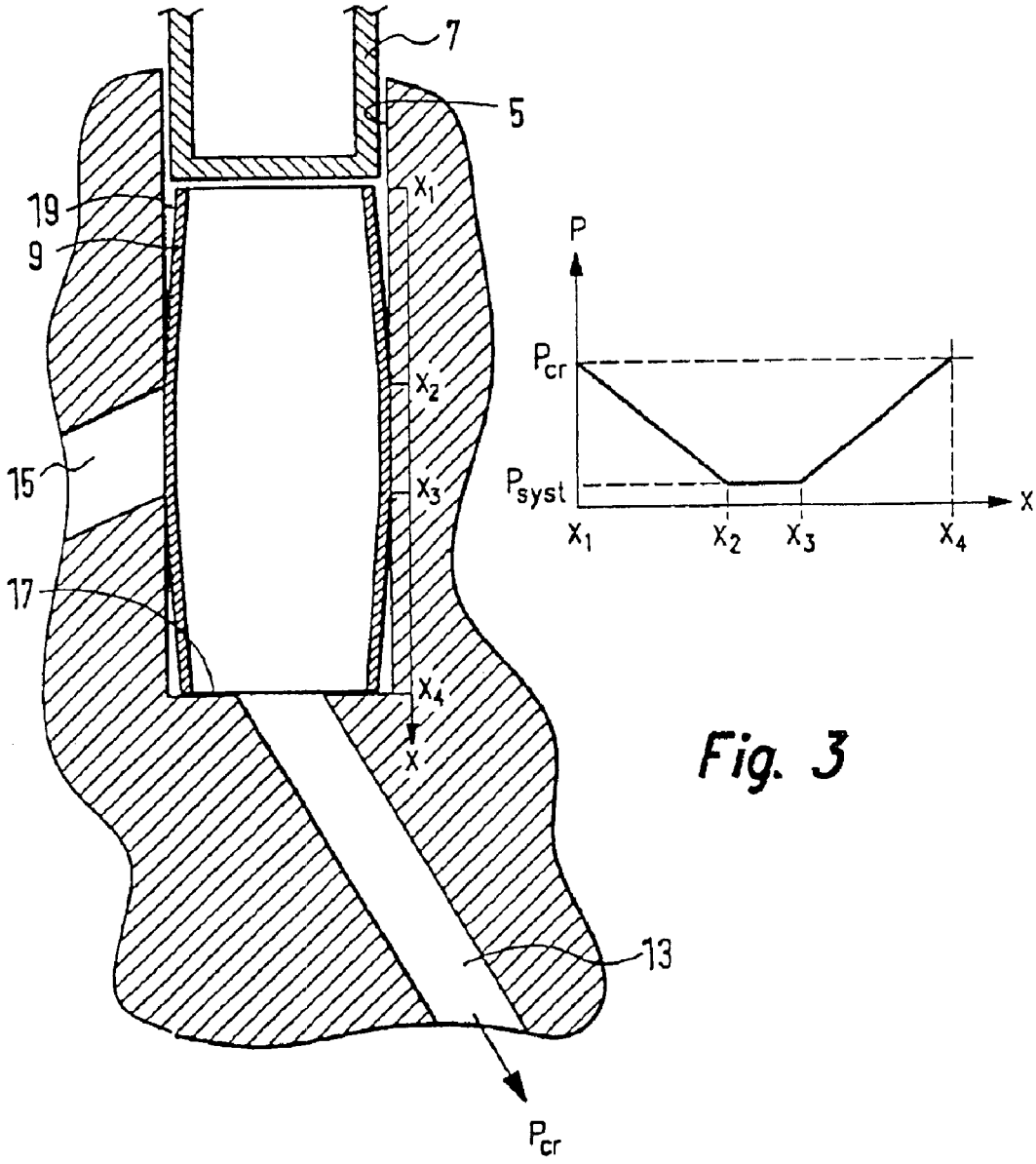
FIG. 3, a detail of a second embodiment of an injector of the invention in longitudinal section.

In FIG. 3, a detail of a second embodiment of an injector of the invention is shown. In this embodiment, the branching point of the conduit 15 to the system pressure supply is equally far away from both ends of the bush 9. As a result, the sealing between the bore 5 and the longitudinal bore 11 on one end of the bush 9 can be omitted, since the fuel must in every case flow through the annular gap 19 before it reaches the conduit 15.

In FIG. 3, the bush 9 is shown deformed. Neither the deformation of the bush 9 nor the size of the annular gap 19 is shown to scale but instead is shown only qualitatively. The pressure course in the annular gap is shown qualitatively in the P/X graph in FIG. 3. In this graph, "X" is the location coordinate extending in the direction of the longitudinal axis of the bore 5.

As the pressure $P_{syst}$ continues to rise, the deformation of the bush 9 becomes so great that there is no longer any annular gap in the region of the branching point of the conduit 15; that is, the fuel can no longer flow into the conduit 15.

Figure 4:
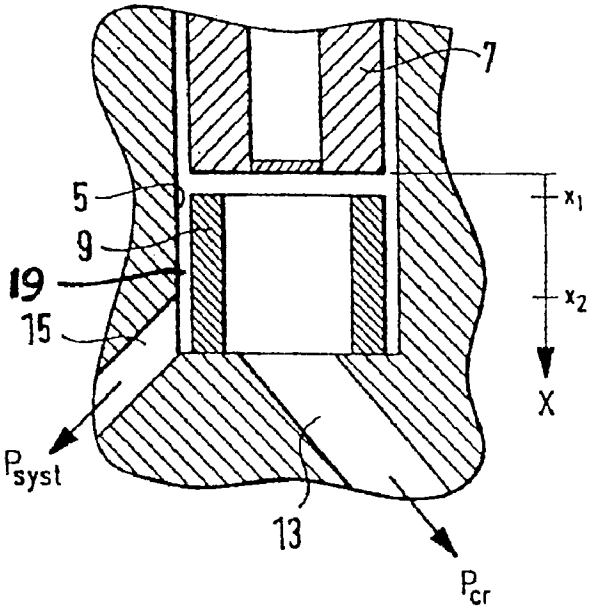
FIG. 4, a qualitative graph of flow rate and pressure for a system pressure supply of the invention for an injector.
Figure 4:
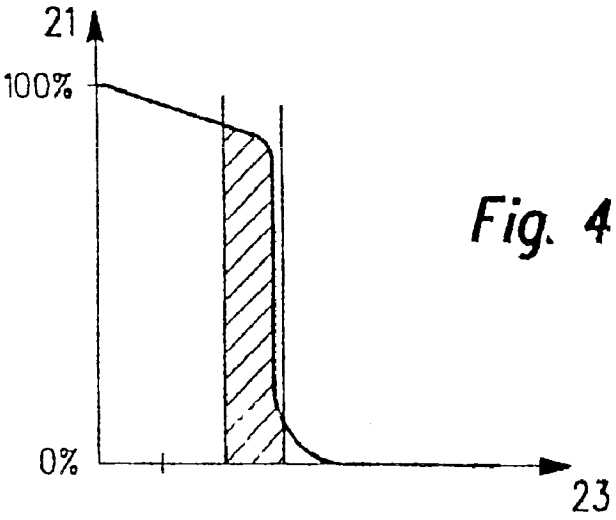

In FIG. 4, the relationship between the fuel flow rate 21 in the annular gap 19 and the pressure 23 in the high-pressure connection 3 is shown qualitatively. From this graph it becomes clear that with increasing pressure 23 in the high-pressure connection 3, the fuel flow rate 21 through the annular gap 19 decreases, until it becomes zero when a certain pressure is reached.

The foregoing relates to preferred exemplary embodiments of the invention, it being understood that other variants and embodiments are possible within the spirit and scope of the invention, the latter being defined by the appended claims.

What is claimed is:

1. An injector for a fuel injection system for internal combustion engines, comprising:

a high-pressure connection (3) having a bore (5) therein, wherein the high-pressure connection (3) communicates hydraulically with an inflow conduit (13) via the bore (5), a conduit (15) to a system pressure supply branching off from the bore (5) of the high-pressure connection (3), and a bush (9) with a longitudinal bore (11) disposed in the bore (5) of the high-pressure connection (3), the inflow conduit (13) being supplied with fuel from the high-pressure connection (3) through the longitudinal bore (11) of the bush (9), and the fuel inflow to the conduit (15) to the system pressure supply being effected through an annular gap (19) formed between an outer circumferential surface of the bush (9) and the bore (5) of the high-pressure connection (3).

2. The injector of claim 1 wherein the thickness of the annular gap (19) between the bore (5) of the high-pressure connection (3) and the bush (9) is 3 to 4 $\mu$m.

3. The injector of claim 2 wherein at one end of the bush (9), the longitudinal bore (11) of the bush (9) and the bore (5) of the high-pressure connection (3) are sealed off from one another, and that in the region of this end, the conduit (15) to the system pressure supply branches off from the bore (5) of the high-pressure connection (3).

4. The injector of claim 2 wherein both ends of the bush (9) are approximately equally spaced from the branching point of the conduit (15) to the system pressure supply.

5. The injector of claim 1 wherein at one end of the bush (9), the longitudinal bore (11) of the bush (9) and the bore (5) of the high-pressure connection (3) are sealed off from one another, and that in the region of this end, the conduit (15) to the system pressure supply branches off from the bore (5) of the high-pressure connection (3).

6. The injector of claim 1 wherein both ends of the bush (9) are approximately equally spaced from the branching point of the conduit (15) to the system pressure supply.

7. The injector of claim 1 wherein the injector further comprising a leak fuel return line.

8. The injector of claim 7 wherein the leak fuel return line communicates with the conduit (15) to the system pressure supply.

9. The injector of claim 8 further comprising a pressure holding valve (18) disposed in the leak fuel return line.

10. The injector of claim 9 wherein the pressure holding valve (18) maintains a minimum pressure, in particular of 15 to 20 bar, in the conduit (15) to the system pressure supply.

11. The injector of claim 7 further comprising a pressure holding valve (18) disposed in the leak fuel return line.

12. The injector of claim 11 wherein the pressure holding valve (18) maintains a minimum pressure, in particular of 15 to 20 bar, in the conduit (15) to the system pressure supply.

13. The injector of claim 1 wherein the injector has a piezoelectric actuator.

14. The injector of claim 13 characterized in that in the injector between the piezoelectric actuator and a control valve, a hydraulic booster is present, which is filled via the conduit (15) to the system pressure supply.

* * * * *